US006591522B2

(12) United States Patent
Doss

(10) Patent No.: US 6,591,522 B2
(45) Date of Patent: Jul. 15, 2003

(54) DATE CYCLING STORAGE CALENDAR

(76) Inventor: Cathryne Doss, 9024 Pamunkey River Farms Dr., Mechanicsville, VA (US) 23111

( * ) Notice: Subject to any disclaimer, the term of this patent is extended or adjusted under 35 U.S.C. 154(b) by 20 days.

(21) Appl. No.: 09/748,851

(22) Filed: Dec. 28, 2000

(65) Prior Publication Data

US 2002/0083627 A1 Jul. 4, 2002

(51) Int. Cl.[7] ..... G09D 3/02; G09F 1/10

(52) U.S. Cl. ..... 40/122; 40/107; 40/124.2; 312/234.4; 211/90.02

(58) Field of Search ..... 40/490, 107, 110, 40/120, 122, 124, 124.2; 283/2; 312/234.4, 234, 246, 122, 245, 234.5; 211/90.02, 90.04, 55, 50, 10

(56) References Cited

U.S. PATENT DOCUMENTS

| | | | | | |
|---|---|---|---|---|---|
| 811,846 | A | | 2/1906 | Hidden | |
| 1,108,893 | A | * | 9/1914 | Ellinwood | 312/234.5 X |
| 1,156,812 | A | * | 10/1915 | Probert | 312/234.5 |
| 1,568,729 | A | * | 1/1926 | Gearon | 312/234 X |
| 2,831,278 | A | | 4/1958 | Myers | 40/107 |
| 3,207,421 | A | | 9/1965 | Hunger et al. | |
| 3,466,126 | A | * | 9/1969 | Sakamoto | 40/124 X |
| 3,911,606 | A | | 10/1975 | Hunkins | 40/110 |
| 3,983,649 | A | | 10/1976 | Ellis et al. | 40/122 |
| 4,192,439 | A | * | 3/1980 | Segal | 312/234 X |
| 4,321,763 | A | * | 3/1982 | Soucy | 40/120 |
| 4,640,560 | A | * | 2/1987 | Blum | 312/234 X |
| 4,863,386 | A | | 9/1989 | Maxey | 434/304 |
| 4,975,061 | A | | 12/1990 | Avrill | 434/304 |
| 5,092,062 | A | * | 3/1992 | Palka | 40/124.2 |
| 5,214,869 | A | | 6/1993 | Wilen | 40/122 |
| 5,412,886 | A | | 5/1995 | Quinn | 40/119 |
| 5,755,337 | A | * | 5/1998 | Linn | 211/50 X |
| 5,797,204 | A | | 8/1998 | Paulos | 40/122 |
| 5,813,539 | A | | 9/1998 | DePalma | 40/107 X |

FOREIGN PATENT DOCUMENTS

| | | | | |
|---|---|---|---|---|
| GB | 305807 | * | 2/1929 | 40/107 |

* cited by examiner

*Primary Examiner*—Joanne Silbermann
(74) *Attorney, Agent, or Firm*—Hunton & Williams

(57) ABSTRACT

A three dimensional, interchangeable calendar capable of organizing an individual or family's schedule. The calendar includes multiple rows of storage trays, each of which has multiple compartments. The calendar utilizes the storage compartments behind each individual date to place cards or other items that can serve as reminder of daily commitments. Each compartment correlates to a single day. The storage trays themselves are also movable and positionable at different locations on the housing. The calendar permits the user to cycle in new dates as he or she desires and to maintain essentially a rolling calendar of commitments for the upcoming weeks.

21 Claims, 5 Drawing Sheets

DATE CYCLING STORAGE CALENDAR

BACKGROUND OF THE INVENTION

1. Field of the Invention

The invention is generally related to calendars, and more particularly to calendars that are used to store reminder information and other articles for the convenience of the user.

2. Background Description

In the modern home, calendars are commonly used to keep track of the family's daily appointments and activities. The most common form of calendar used remains the single page monthly layout format. Families use these calendars to post important reminders for birthdays, doctor's appointment, soccer practices, etc. These days, however, families are usually so busy that most monthly calendars do not have enough space in each daily spot to record all the day's activities. This necessitates a more robust calendar, capable of organizing the modem family's schedule.

Calendar organization systems are available in a variety of forms. Each with it's uniquenesses as well as limitations. A sample of what has been patented includes the following: The Calendar Organizer, U.S. Pat. No. 5,813,539 to DePalma—A monthly organizer using pouches to represent the days of the month. The Calendar Organizing System, U.S. Pat. No. 5,797,204 to Paulos—A monthly organizer with pockets for receiving documents for each day of the month. Calendar Oriented Monthly Bill Payment Sorter, U.S. Pat. No. 5,412,886 to Quinn—A calendar and mail sorting structure with slots for holding mail for the month. Child's Holiday Calendar, U.S. Pat. No. 4,975,061 to Avrill—Utilizes a matrix of pockets to temporarily position visual markers for association with a target date of a predetermined month associated with a calendar. Calendar Kit and Method of Use, U.S. Pat. No. 3,911,606 to Hunkins—A kit with a backing sheet having T-shaped reminder tabs and a plurality of calendar sheets each having horizontal slits associated with respective date spaces.

SUMMARY OF THE INVENTION

It is an object of this invention to provide a more robust calendar which accommodates effective scheduling.

According to this invention, a three dimensional, interchangeable calendar therein utilizes storage spaces behind each individual date to place cards or other items that can serve as reminder of daily commitments. Reusable cards, business cards, or other materials will serve as the reminders. Further, special cards can be tailored for use with the calendar. The calendar includes a set of storage trays, each of which has multiple compartments. Each compartment correlates to a single day. Identifiers, such as numerical indicia on substrates, are associated with each compartment. These identifiers can be removed and re-used on different compartments after a day expires. The storage trays themselves are also movable and positionable at different locations on the housing. The goal of the calendar is to permit the user to cycle in new dates as he or she desires and to maintain essentially a rolling calendar of commitments for the upcoming weeks. Preferably, the calendar accommodates five weeks of dates, thus presenting with enough information to satisfy the length of any single month. In addition, by rolling and cycling though dates, the user can see his or her commitment in parts of any two continuous months.

DETAILED DESCRIPTION OF A PREFERRED EMBODIMENT OF THE INVENTION

Figure 1:
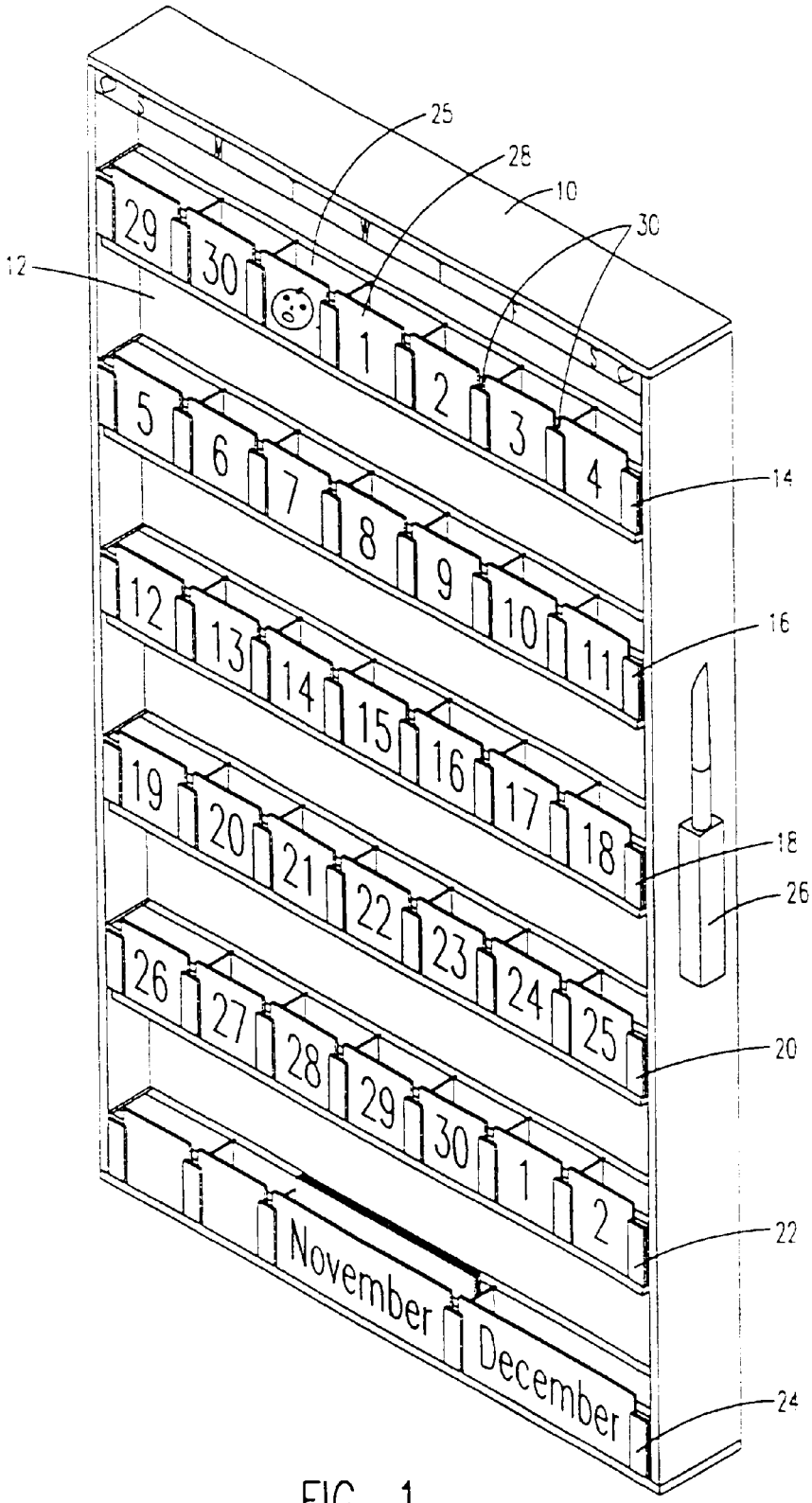
FIG. 1 is an isometric view of the entirety of the invention. It shows the support chamber with the five rows of storage trays with a compartment for each day of the month. An additional row of compartments is also available for holding and displaying the current and upcoming months, and for storing future months and additional display cards.

Referring to FIG. 1, the calendar assembly includes an outer frame 10, a backing 12, and six evenly spaced rows 14, 16, 18, 20, 22, and 24 contained in the frame. On the front of each row are slots 30 for placing the numbered pieces 28 to represent the days of the month. Of the six rows, five are dedicated for daily slots, with an additional row for displaying the month and storing additional months and display cards. The rows for daily slots are divided into seven separate compartments 25, one for each day. The additional storage row may be located as either the top or bottom row of the support chamber or at other locations as desired. The preferred embodiment uses seven days and six trays; however it will be understood that the amount of compartments for the days and the number of trays can be varied. The frame, backing, storage rows, and numbered pieces may be constructed from a combination of commonly available materials such as wood, plastic, and metal.

In total, the calendar preferably contains enough numbered slots for the user to map out a 5 week schedule. The easy interchangeability of the numbered day pieces allows the user to have a rolling 35 day schedule. For example, once the first week of the month is over, the tray 14 can be rotated down to the bottom of the calendar and used for the first days of the next month (i.e. at the position tray 22 currently resides), while each of the trays 16, 18, 20, and 22 are shifted one slot up. A numbered day piece may be exchanged for a "special occasion" piece when appropriate, e.g., "Halloween" instead of "31." Further, a penholder 26 can be mounted on both sides of the support chamber or at other locations for holding pens or markers. FIG. 1 shows a penholder on one side of the housing.

The storage areas behind each day allow a user to store individual cards representing a child's birthday, a child's soccer practice, or possibly a dentist appointment. Further, a child might use the slots to hold her birthday wishes written on a card. Although these important dates can be written on any type of paper or card, reusable quick erase cards may be preferred. Different colored cards can represent special events as well. Appointments and special event reminders that are outside of the current 35 day schedule are stored, for future placement, on the additional storage row behind their respective month. Furthermore, the depth of each individual storage area preferably allows the user to place many different items of interest behind a given date. Keys, credit cards, or even a pair of glasses could be placed in the storage area as well. Thus, the invention has many uses.

Figure 2:
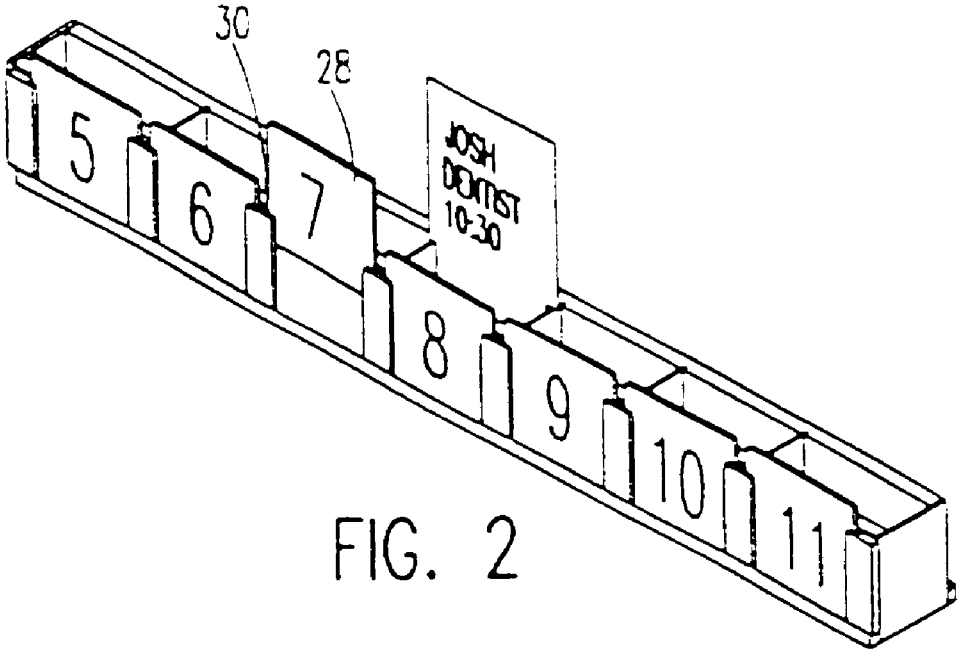
FIG. 2 shows the front view of a single storage tray with identifiers which slides into their holding slots; also shown is a reminder card displayed in the compartment for day eight.

FIG. 2 shows one of the five rows of storage trays dedicated for daily slots. Each row contains seven identifiers 28 for each day of the week. The identifiers are held in place by slots 30 on each side which each identifier can slide in and out of in order to match the date to the day of the week for that particular month. Of course, other means of securing the identifiers 28 could also be used, such as magnets, velcro, etc.

Figure 3:
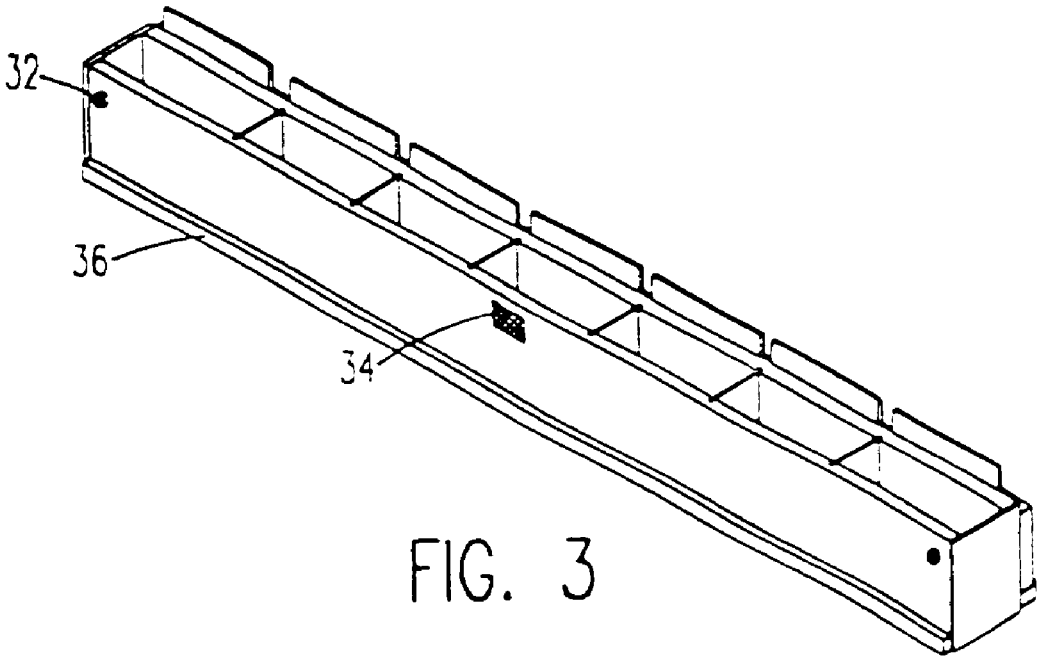
FIG. 3 shows the backside view of a storage tray. A velcro attachment piece is in the center and on each end is a metal screw for magnetic attachment to magnets on the facing surface of the support chamber.
Figure 4:
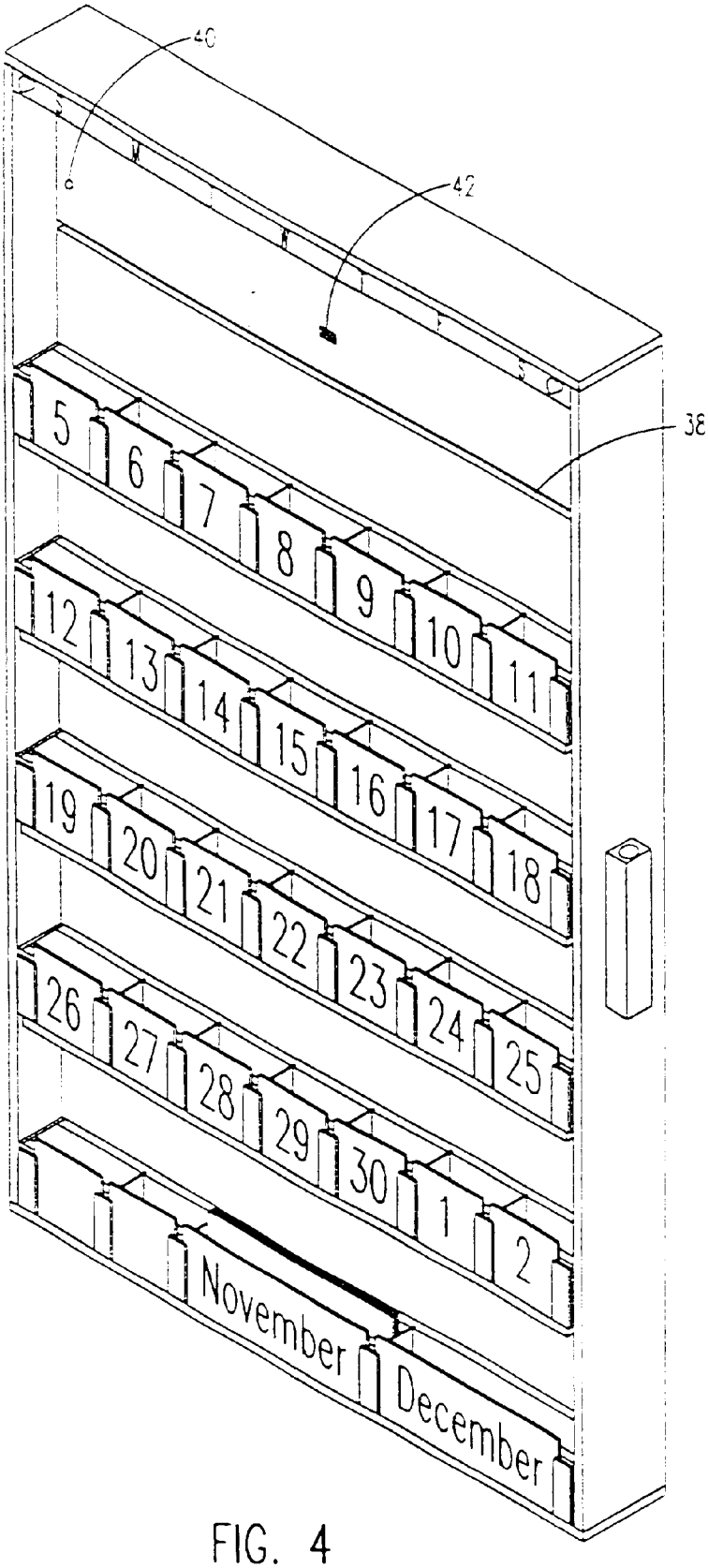
FIG. 4 shows the support chamber with the top row of storage tray removed to show attachment devices and slot on the back surface.

FIG. 3 shows the back-side view of a storage tray. On each end of the backside there is preferably a metal screw 32 which will attach to the magnet on the back surface of the support chamber. A velcro connector piece may also be placed in the middle of the row of storage tray for attachment to the support chamber. The storage tray is constructed so that it's bottom piece 36 protrudes Out as a flange beyond the back side. This extension allows it to fit into the horizontal slots 38 which are cut into the inside back face of the support chamber, as shown in FIG. 4. On the inside back face of the support chamber there are preferably mounted magnets 40, one on each end for each row of storage trays, which the metal screws 32 attach to. A velcro attachment 42 may also be located in the middle of the support chamber's inside hack face for each row of storage tray. Other methods of attachment, such as bayonet connectors, snaps, etc. may be used in place of the magnetic and velcro attachments.

Figure 5:
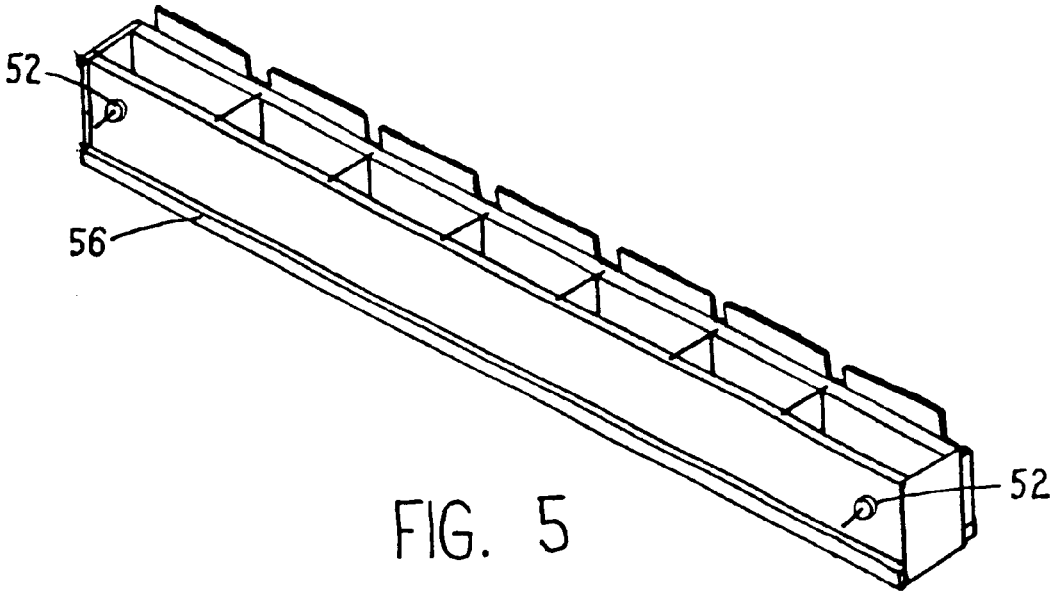
FIG. 5 shows a back-side view of a storage tray in accordance with another embodiment of the invention.
Figure 6:
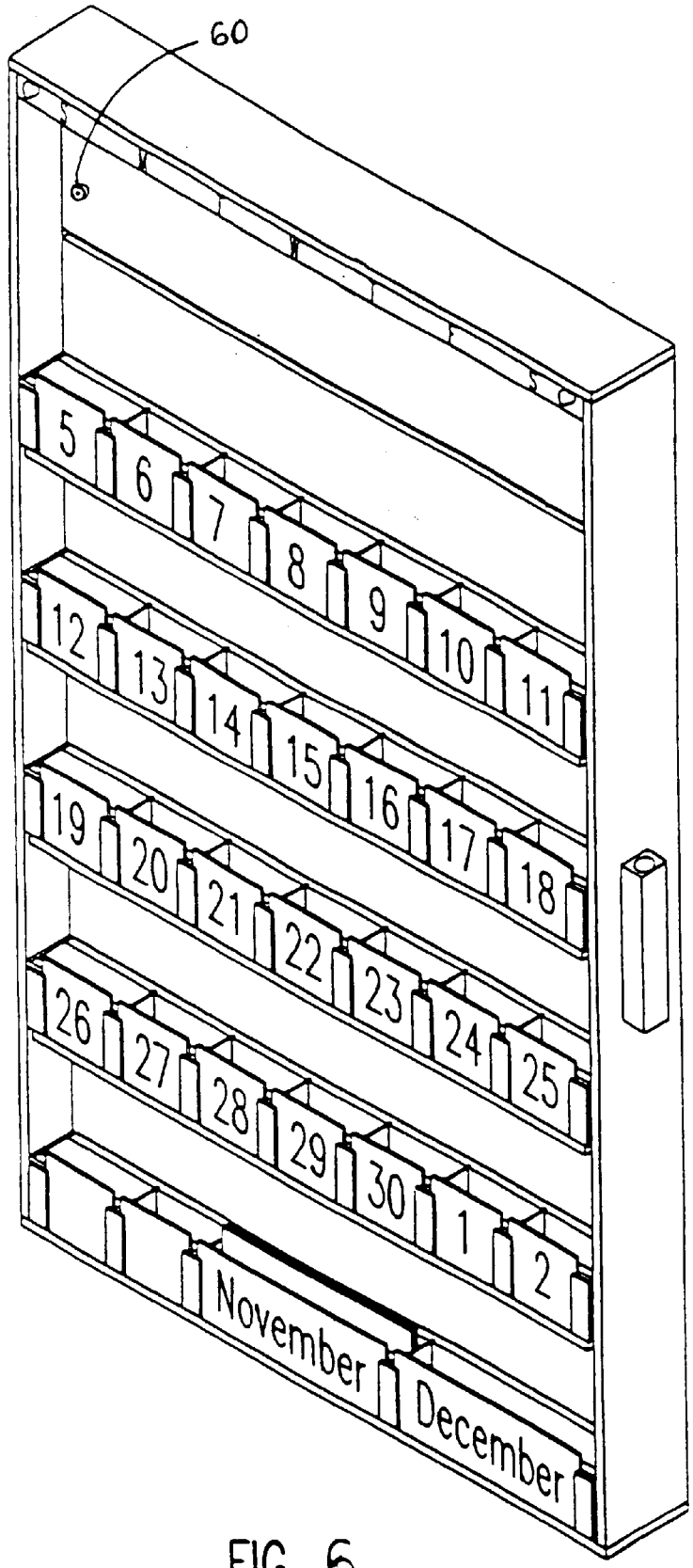
FIG. 6 shows the support chamber with the top row of storage tray removed in accordance with another embodiment of the inventory.

FIG. 5 shows a back-side view of a storage tray in accordance with another embodiment of the invention. As described above, bayonet connectors 52 may be used to attach the storage tray to the inside back face of the support chamber. Bayonet connectors 52 may be positioned on the back-side of the storage tray, similar to the screws 32 shown in FIG. 3. Bayonet connectors 52 may be secured to bayonet connector receivers 60 positioned on the inside back face of the support chamber, as shown in FIG. 6. The storage tray also includes bottom piece 56, which protrudes out as a flange beyond the back side.

What is claimed is:

1. A calendar, comprising;

a support chamber;

a plurality of storage trays, each of said storage trays having a plurality of compartments for storing articles, each of said plurality compartments having an identifier receiving member;

a plurality of identifiers each of which is securable to and removable from one or more identifier receiving members on said plurality of compartments, each of said identifiers includes calendar information indicia therein; and a plurality of securing mechanisms for securing said storage trays to said support chamber, the plurality of securing mechanisms permitting detachment of a storage tray at one location and reattachment at another location, wherein at least one of said securing mechanisms includes hook and loop connectors secured to facing surfaces on said support chamber and said storage trays.

2. A calendar, as recited in claim 1, wherein said identifier receiving members are positioned on a front surface of each of said storage trays.

3. A calendar, as recited in claim 2, wherein said identifier is a substrate and wherein said identifier receiving members include slotted regions on opposing sides of said compartment for receiving opposing edges of said substrate.

4. A calendar, as recited in claim 1, wherein said calendar information indicia are selected from the group consisting of dates and months.

5. A calendar, as recited in claim 1, wherein each of said plurality of storage trays includes at least seven compartments.

6. A calendar, as recited in claim 1, wherein said plurality of storage trays includes at least five storage trays.

7. A calendar, as recited in claim 1, further comprising an auxiliary storage that is connectable to said support member at a desired location.

8. A calendar, as recited in claim 1, further comprising an auxiliary tray including at least two compartments and at least two indicators respectively associated with at least two compartments on said auxiliary tray.

9. A calendar, as recited in claim 1, wherein at least one of said securing mechanisms includes a flange which extends from a rear surface of each of said storage trays, and slots formed in said support chamber for receiving said flange.

10. A calendar, as recited in claim 1, wherein said support chamber includes side members which form a housing in which said storage trays are housed when they are secured to said support chamber.

11. A calendar, as recited in claim 10, further comprising a writing instrument securing member extending from at least one of said side members.

12. A calendar, as recited in claim 1, wherein said calendar information indicia are numerals.

13. A calendar, as recited in claim 1, wherein at least one of said securing mechanisms extends from a rear surface of each of said storage trays and being receivable in a complimentary securing mechanism formed in the support chamber.

14. A calendar, comprising;

a support chamber;

a plurality of storage trays, each of said storage trays having a plurality of compartments for storing articles, each of said plurality compartments having an identifier receiving member;

a plurality of identifiers each of which is accurable to and removable from one or more identifier receiving members on said plurality of compartments, each of said identifiers includes calendar information indicia therein; and a plurality of securing mechanism for securing said storage trays to said support chamber, the plurality of securing mechanisms permitting detachment of a storage tray at one location and reattachment at another location, wherein at least one of said securing mechanisms includes magnets secured to the support chamber.

15. A calendar, as recited in claim 14, wherein said identifier receiving members are positioned on a front surface of each of said storage trays.

16. A calendar us recited in claim 15, wherein said identifier is a substrate and wherein said identifier receiving members include slotted regions on opposing sides of said compartment for receiving opposing edges of said substrate.

17. A calendar, as recited in claim 14, wherein said calendar information indicia are selected from the group consisting or dales and months.

18. A calendar, as recited in claim 14, wherein at least one of said securing mechanisms includes a flange which extends from a rear surface of each of said storage trays, and slots formed in said support chamber for receiving said flange.

19. A calendar, as recited in claim 14, wherein at least one of said securing mechanisms extends from a rear surface of each of said storage trays and being receivable in a complimentary securing mechanism formed in the support chamber.

20. A calendar, as recited in claim 14, further including a plurality of screws secured to each storage tray for engaging the magnets.

21. A calendar, comprising;

a support chamber;

a plurality of storage trays, each of said storage trays having a plurality of compartments for storing articles, each of said plurality compartments having an identifier receiving member;

a plurality of identifiers each of which is securable to and removable from one or more identifier receiving members on said plurality of compartments, each of said identifiers includes calendar information indicia therein; and a plurality of securing mechanisms for securing said storage trays to said support chamber, the plurality of securing mechanisms permitting detachment of a storage tray at one location and reattachment at another location, wherein at least one of said securing mechanisms includes bayonet connectors secured to facing surfaces on said support chamber and said storage trays.

* * * * *

UNITED STATES PATENT AND TRADEMARK OFFICE

CERTIFICATE OF CORRECTION

PATENT NO. : 6,591,522 B2
DATED : July 15, 2003
INVENTOR(S) : Cathryne Doss

It is certified that error appears in the above-identified patent and that said Letters Patent is hereby corrected as shown below:

Column 4,
Line 56, the word “us” should read -- as --;
Line 63, the words “or dales” should read -- of dates --.

Signed and Sealed this

Sixteenth Day of September, 2003

JAMES E. ROGAN
*Director of the United States Patent and Trademark Office*